US010336108B2

(12) United States Patent
Stangler et al.

(10) Patent No.: US 10,336,108 B2
(45) Date of Patent: Jul. 2, 2019

(54) CREDENTIAL PRODUCTION DEVICE HAVING A MOVABLE PROCESSING ASSEMBLY

(71) Applicant: Assa Abloy AB, Stockholm (SE)

(72) Inventors: Jeffrey Stangler, Eden Prairie, MN (US); James Rieck, Brooklyn Park, MN (US); Ted M. Hoffman, Eden Prairie, MN (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 15/563,995

(22) PCT Filed: May 12, 2015

(86) PCT No.: PCT/IB2015/053496
§ 371 (c)(1),
(2) Date: Oct. 3, 2017

(87) PCT Pub. No.: WO2016/181190
PCT Pub. Date: Nov. 17, 2016

(65) Prior Publication Data

US 2018/0134053 A1 May 17, 2018

(51) Int. Cl.
*B41M 3/00* (2006.01)
*B41J 17/24* (2006.01)
(Continued)

(52) U.S. Cl.
CPC ..... *B41J 17/24* (2013.01); *B41J 2/0057* (2013.01); *B41J 2/325* (2013.01); *B41J 17/22* (2013.01);
(Continued)

(58) Field of Classification Search
CPC .... B41J 2/0057; B41J 2/325; B41J 2002/012; B41J 17/24; B41J 17/22; B41J 17/28; B41M 3/00
(Continued)

(56) References Cited

U.S. PATENT DOCUMENTS 4,744,680 A * 5/1988 Hirosaki ..... B41J 17/24 347/216
4,997,298 A 3/1991 Uchimura et al.
(Continued)

FOREIGN PATENT DOCUMENTS

EP 2698253 A2 2/2014
WO 2011035117 A1 3/2011
(Continued)

OTHER PUBLICATIONS

International Search Report and Written Opinion of PCT/IB2015/053496, dated Feb. 5, 2016.
(Continued)

*Primary Examiner* — Huan H Tran
*Assistant Examiner* — Alexander D Shenderov
(74) *Attorney, Agent, or Firm* — Schwegman Lundberg & Woessner, P.A.

(57) ABSTRACT

A credential production device includes a processing path, a transport mechanism, a processing assembly and at least one assembly guide. The transport mechanism is configured to feed individual substrates along the processing path. The processing assembly includes a supply spool support, a take-up spool support, a plurality of ribbon supports, and a print head or a transfer roller. Each assembly guide is configured to guide movement of the processing assembly substantially perpendicularly to the processing path between an operating position and a loading position relative to the processing path.

20 Claims, 9 Drawing Sheets

(51) Int. Cl.

| | |
|---|---|
| ***B41J 17/28*** | (2006.01) |
| ***B41J 2/005*** | (2006.01) |
| ***B41J 2/325*** | (2006.01) |
| ***B41J 17/22*** | (2006.01) |
| *B41J 2/01* | (2006.01) |

(52) U.S. Cl.
CPC ..... *B41J 17/28* (2013.01); *B41M 3/00* (2013.01); *B41J 2002/012* (2013.01)

(58) Field of Classification Search
USPC ..... 347/103
See application file for complete search history.

(56) References Cited

U.S. PATENT DOCUMENTS

| | | | | |
|---|---|---|---|---|
| 5,157,413 | A * | 10/1992 | Nagato | B41J 2/325 347/199 |
| 5,440,328 | A | 8/1995 | Nardone et al. | |
| 6,261,012 | B1 | 7/2001 | Haas et al. | |
| 6,682,241 | B2 | 1/2004 | Coons et al. | |
| 6,981,536 | B2 | 1/2006 | Lien et al. | |
| 7,922,407 | B2 | 4/2011 | Hoffman | |
| 2002/0041782 | A1 | 4/2002 | Mastinick et al. | |
| 2008/0217842 | A1 * | 9/2008 | Hoffman | B41J 11/0015 271/167 |

FOREIGN PATENT DOCUMENTS

| | | | |
|---|---|---|---|
| WO | 2012068022 | A2 | 5/2012 |
| WO | 2016110746 | A1 | 7/2016 |

OTHER PUBLICATIONS

First Office Action from corresponding Chinese Patent Application No. 201580079876.2, dated Dec. 11, 2018.

* cited by examiner

CREDENTIAL PRODUCTION DEVICE HAVING A MOVABLE PROCESSING ASSEMBLY

CROSS-REFERENCE TO RELATED APPLICATION

This Application is Section 371 National Stage Application of International Application No. PCT/IB2015/053496, filed May 12, 2015 and published as WO 2016/181190 A1 on Nov. 17, 2016, in English, the contents of which are hereby incorporated by reference in their entirety.

BACKGROUND

Credentials include identification cards, driver's licenses, passports, and other documents. Such credentials are formed from credential or card substrates including paper substrates, plastic substrates, cards, and other materials. Such credentials generally include printed information, such as a photo, account numbers, identification numbers, and other personal information. Credentials can also include data that is encoded in a smartcard chip, a magnetic stripe, or a barcode, for example.

Credential production devices include processing devices that process credential substrates by performing at least one processing step in forming a final credential product. Such processes generally include a printing process, a laminating or transfer process, a data reading process, a data writing process, and/or other process used to form the desired credential.

In a printing process, a printing device is used to print an image either directly to the substrate (i.e., direct printing process) or to a print intermediate, from which the image is transferred to the substrate (i.e., reverse-image transfer printing process). Typical printing devices include a thermal print head, which prints an image by heating and transferring dye from a print ribbon, and an ink jet print head.

In a transfer or laminating process, an overlaminate material is transferred to a surface of the card substrate using a heated laminating or transfer roller. The material may be in the form of a patch laminate or a thin film laminate. The overlaminate material is typically one of two types: a patch laminate, or a fracturable laminate or transfer layer often referred to as a "thin film laminate." The patch laminate is generally a pre-cut polyester film that has been coated with a thermal adhesive on one side. The transfer roller is used to heat the patch to activate the adhesive, and press the adhesive-coated side of the patch to a surface of a substrate to bond the patch to the surface.

Thin film laminates or transfer layers are fracturable laminates that are generally formed of a continuous resinous material that have been coated onto a continuous carrier layer or backing to form a transfer ribbon. The side of the resin material that is not attached to the continuous carrier layer is generally coated with a thermal adhesive which is used to create a bond between the resin and a surface of a substrate. The transfer roller is used to heat the transfer layer to activate the adhesive and press the adhesive-coated side of the transfer layer against the surface of the substrate to bond the material to the surface. The carrier layer or backing is removed to complete the lamination or transfer process.

The transfer layer or patch laminate may also be in the form of a print intermediate, on which an image may be printed in the reverse-image printing process mentioned above. In the reverse-image printing process, an image is printed to the exposed side of the transfer layer or patch laminate. Next, the printed image is registered with the substrate. The transfer roller is then used to perform the transfer or laminating operation described above to bond the transfer layer or patch laminate having the printed image to the surface of the card substrate.

Transfer printing devices generally require the loading of the print ribbon and the transfer ribbon (or a patch laminate ribbon) in the device, such that the print ribbon and the transfer ribbon are positioned for processing by the print head. Additionally, the transfer ribbon must be positioned for processing by the transfer roller. These ribbon loading processes can require the user to delicately feed the print and transfer ribbons through openings, around rollers, and attach an end of the ribbons to a corresponding take-up spool, for example. These ribbon loading processes may also require temporary displacement of one or more components relative to the installed ribbon, which can adversely affect operations of the transfer printing device.

SUMMARY OF ILLUSTRATIVE EMBODIMENTS

Some embodiments of the invention are directed to a credential production device that is configured to perform at least one process on a substrate to form a credential product. In some embodiments, the credential production device includes a processing path, a transport mechanism, a processing assembly, and at least one assembly guide. The transport mechanism is configured to feed individual substrates along the processing path in a feed direction. The processing assembly includes a supply spool support, a take-up spool support, a plurality of ribbon supports, and a print head or a transfer roller. Each assembly guide is configured to guide movement of the processing assembly substantially perpendicularly to the processing path between an operating position and a loading position relative to the processing path.

In some embodiments, the processing assembly is cantilevered by the at least one assembly guide when the processing assembly is in the loading position. In some embodiments, the credential production device includes a main frame having a fixed position relative to the processing path, and each assembly guide includes a first guide member that is attached to the main frame, and a second guide member that is attached to the processing assembly and engages the first guide member. The second guide member and the processing assembly move between the loading and operating positions relative to the main frame and the first guide member. In some embodiments, the first guide member includes a channel that receives an end of the second guide member, and the second guide member slides within the channel of the first guide member as the processing assembly moves between the loading and operating positions.

In some embodiments, the processing assembly includes at least one motor. In some embodiments, the processing assembly includes a supply spool motor configured to rotate the supply spool support, a take-up spool motor configured to rotate the take-up spool support, a feed motor configured to drive rotation of a feed roller, a transfer roller motor configured to drive rotation of the transfer roller, a transfer roller lift motor configured to move an axis rotation of the transfer roller relative to a frame of the processing assembly, and/or a print head lift motor configured to move the print head relative to the frame of the processing assembly.

In some embodiments, the processing assembly is a transfer assembly comprising the transfer roller, which is configured to transfer a section of overlaminate material from a transfer ribbon extending between a supply spool supported by the supply spool support and a take-up spool supported by the take-up spool support to a substrate in the processing path when the transfer assembly is in the operating position. In some embodiments, the overlaminate material comprises a transfer layer or an overlaminate patch.

In some embodiments, the processing assembly is a print assembly comprising the print head, which is configured to print an image using a print ribbon extending between a supply spool supported by the supply spool support and a take-up spool supported by the take-up spool support when the print assembly is in the operating position.

In some embodiments, the credential production device includes both a transfer assembly and a print assembly, and the print assembly is configured to print an image to an overlaminate material of the transfer ribbon. The transfer assembly is configured to perform a transfer lamination operation, during which the imaged overlaminate material is transferred to a surface of a substrate in the processing path.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
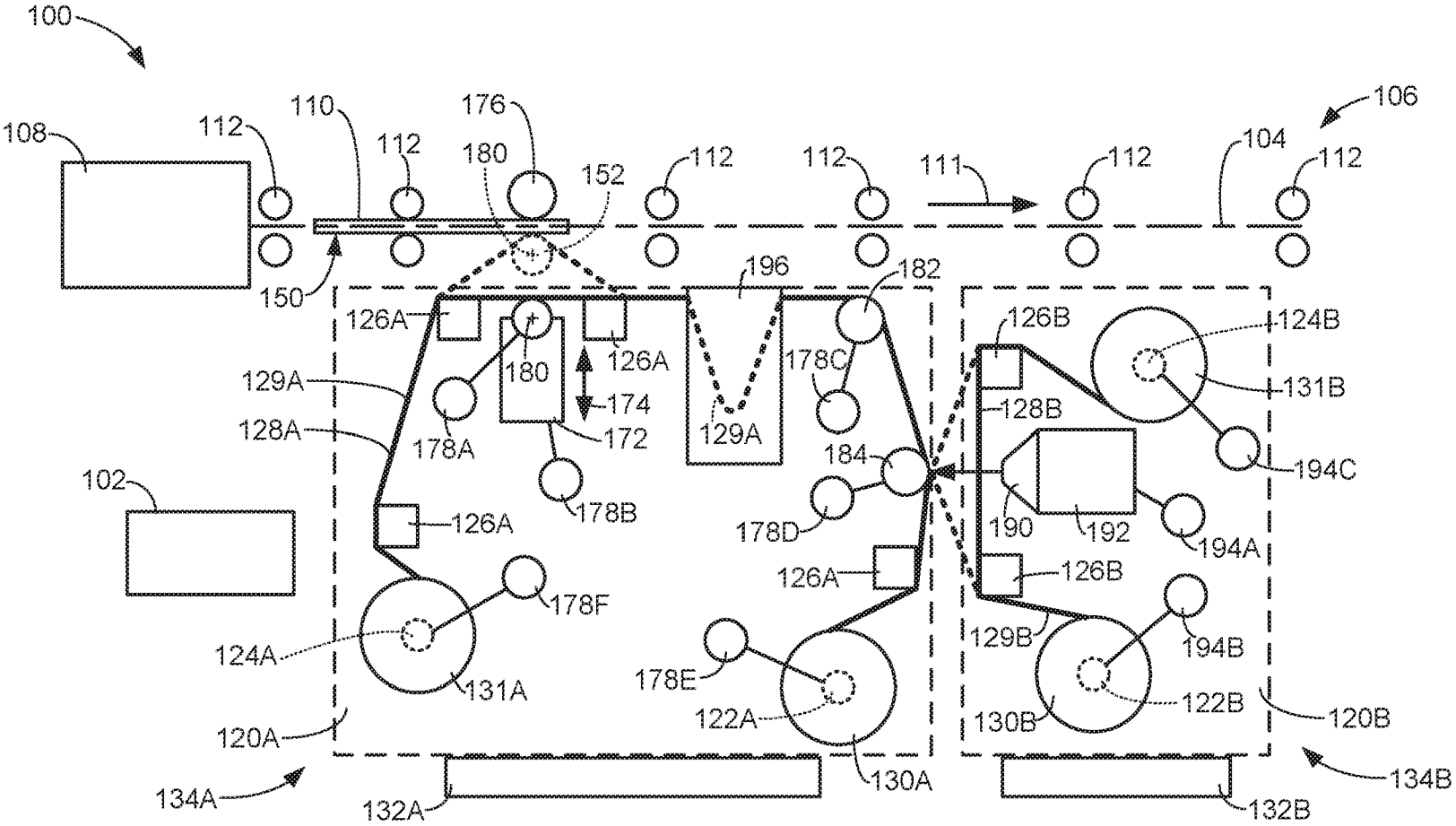
FIG. 1 is a simplified side view of an exemplary credential production device in accordance with embodiments of the invention.

Embodiments of the invention are described more fully hereinafter with reference to the accompanying drawings. Elements that are identified using the same or similar reference characters refer to the same or similar elements. Some elements may be referred generally by a reference number and more specifically by the reference number followed by a letter and/or other reference character. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Specific details are given in the following description to provide a thorough understanding of the embodiments. However, it is understood by those of ordinary skill in the art that the embodiments may be practiced without these specific details. For example, circuits, systems, networks, processes, frames, supports, connectors, motors, processors, and other components may not be shown, or shown in block diagram form in order to not obscure the embodiments in unnecessary detail.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will further be appreciated by one of skill in the art, the present invention may be embodied as methods, systems, devices, and/or computer program products, for example. Accordingly, the present invention may take the form of an entirely hardware embodiment, an entirely software embodiment or an embodiment combining software and hardware aspects. The computer program or software aspect of the present invention may comprise computer readable instructions or code stored in a computer readable medium or memory. Execution of the program instructions by one or more processors (e.g., central processing unit) results in the one or more processors performing one or more functions or method steps described herein. Any suitable patent subject matter eligible computer readable media or memory may be utilized including, for example, hard disks, CD-ROMs, optical storage devices, or magnetic storage devices. Such computer readable media or memory do not include transitory waves or signals.

The computer-usable or computer-readable medium may be, for example, but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present invention may also be described using flowchart illustrations and block diagrams. Although a flowchart may describe the operations as a sequential process, many of the operations can be performed in parallel or concurrently. In addition, the order of the operations may be re-arranged. A process is terminated when its operations are completed, but could have additional steps not included in a figure or described herein.

It is understood that one or more of the blocks (of the flowcharts and block diagrams) may be implemented by computer program instructions. These program instructions may be provided to a processor circuit, such as a microprocessor, microcontroller or other processor, which executes the instructions to implement the functions specified in the block or blocks through a series of operational steps to be performed by the processor(s) and corresponding hardware components.

FIG. 1 is a simplified side view of an exemplary credential production device 100 in accordance with embodiments of the invention. In some embodiments, the device 100 includes a controller 102 representing one or more processors that are configured to execute program instructions stored in memory of the device or other location. The execution of the instructions by the controller 102 controls components of the device 100 to perform functions and method steps described herein.

In some embodiments, the device 100 includes a processing path 104, a transport mechanism 106, and a substrate supply 108. The substrate supply 108 may be in the form of a container or cartridge that is configured to contain individual substrates 110. The substrates 110 are individually fed from the supply 108 along the processing path 104 in a feed direction 111, which is parallel to the processing path 104, for processing using the transport mechanism 106, which is controlled by the controller 102. In some embodiments, the transport mechanism 106 includes one or more motorized feed rollers or feed roller pairs 112, or other suitable mechanism. Sensors may be used to assist the controller 102 in the feeding of the substrates 110 along the processing path 104, and aligning the substrates 110 with substrate processing devices along the processing path 104.

The substrates 110 may take on many different forms, as understood by those skilled in the art. In some embodiments, the substrate 110 is a credential substrate. As used herein, the term "credential substrate" includes substrates used to form credentials, such as identification cards, membership cards, proximity cards, driver's licenses, passports, credit and debit cards, and other credentials or similar products. Exemplary card substrates include paper substrates other than traditional paper sheets used in copiers or paper sheet printers, plastic substrates, rigid and semi-rigid card substrates, and other similar substrates.

In some embodiments, the device 100 includes at least one processing assembly, generally referred to as 120. In some embodiments, the at least one processing assembly 120 includes an assembly 120A and/or an assembly 120B. While embodiments described herein may refer to both processing assemblies 120A and 120B, it is understood that such embodiments may apply to only a single processing assembly 120 of the device 100.

In some embodiments, each processing assembly 120 includes a supply spool support 122 (e.g., 122A, 122B), a take-up spool support 124 (e.g., 124A, 124B), and a plurality of ribbon supports 126 (e.g., 126A, 126B) that define a ribbon path 128 (e.g., 128A, 128B) on which a ribbon 129 (e.g., 129A, 129B) is supported. In some embodiments, the ribbons 129A and 129B each extend between a supply spool 130A and 130B to a take-up spool 131A and 131B, respectively. In some embodiments, the supply spool supports 122A and 122B are respectively configured to support the supply spools 130A and 130B, and the take-up spool supports 124A and 124B are respectively configured to support the take-up spools 131A and 131B, as shown in FIG. 1.

Figure 2:
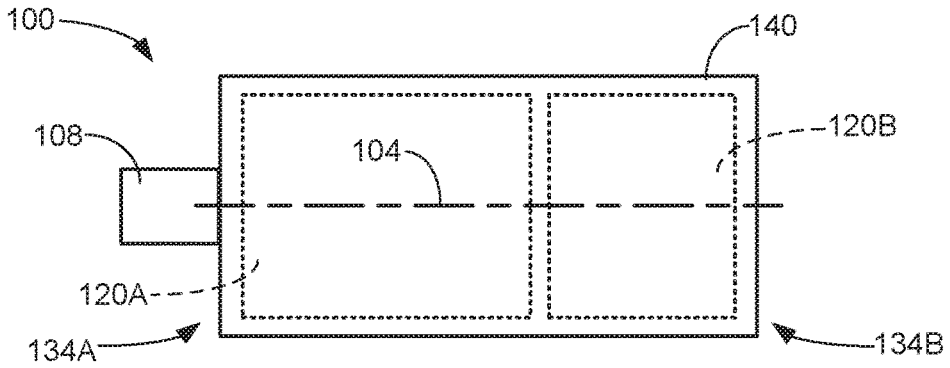
FIGS. 2-4 are simplified top views of a credential production device in accordance with embodiments of the invention.
Figure 3:
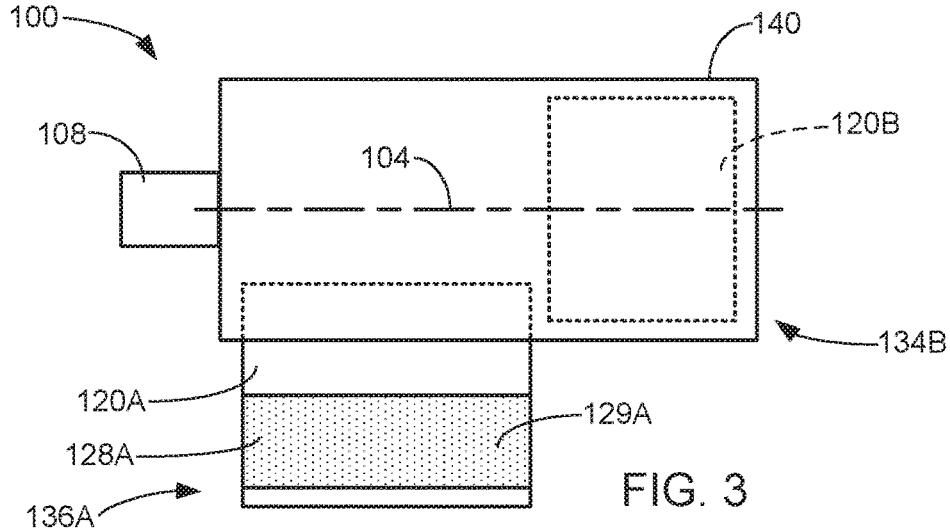
Figure 4:
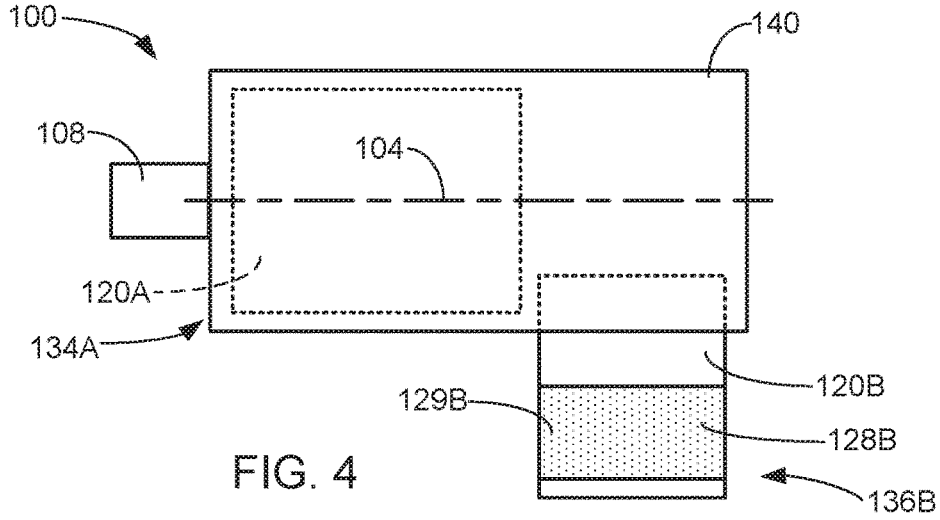

In some embodiments, each of the processing assemblies 120 include an assembly guide 132 (e.g. 132A, 132B), which is schematically illustrated in FIG. 1. Each assembly guide 132 is configured to guide movement of the corresponding processing assembly 120, substantially perpendicularly to the processing path 104 between an operating position 134 (e.g., 134A, 134B) and a loading position 136 (e.g., 136A, 136B) relative to the processing path 104, as shown in FIGS. 2-4, which are simplified top views of the credential production device 100, in accordance with embodiments of the invention. In some embodiments, each processing assembly 120 is configured to perform a process in the production of a credential product using the corresponding ribbon 129 when in the operating position 134. In some embodiments, each processing assembly 120 is positioned to facilitate loading and unloading the ribbon 129 when the processing assembly 120 is in the loading position 136.

Figure 5:
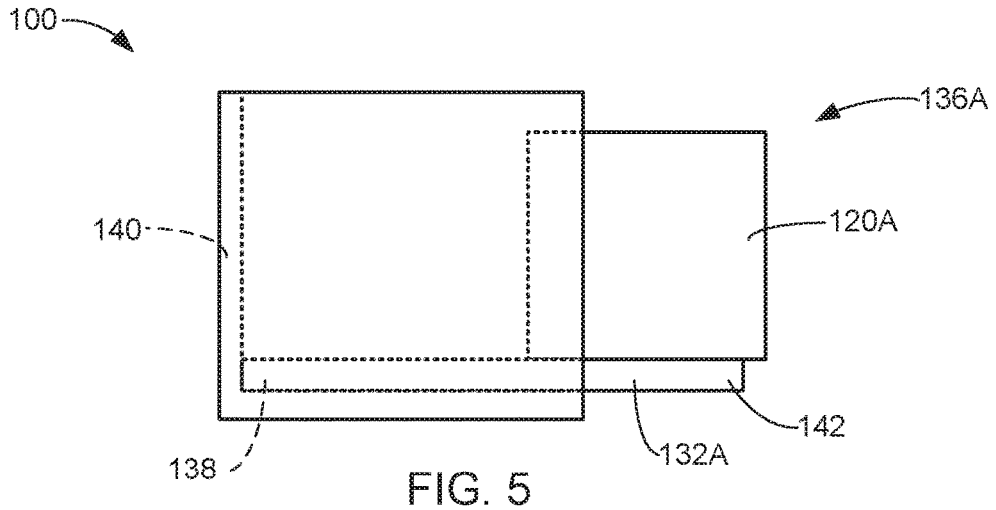
FIG. 5 is a simplified side view of a credential production device in accordance with embodiments of the invention.

In some embodiments, each processing assembly 120 is cantilevered by the corresponding assembly guide 132 when the processing assembly 120 is in the loading position 136, as shown in the simplified side view of FIG. 5. In some embodiments, when the processing assembly 120 is in the cantilevered loading position 136, the assembly guide 132 has an end 138 that is supported by or attached to a frame or main frame 140 of the credential production device 100, while the opposing end 142, which supports the processing assembly 120, is unsupported. In some embodiments, the frame 140 is a structure that generally has a fixed position relative to a counter or surface on which the device 100 is supported, during normal use of the device 100. In some embodiments, the frame 140 has a fixed position relative to the processing path 104. In some embodiments, the frame 140 includes one or more side walls, a base structure, and/or other components of the device 100. In some embodiments, the one or more processing assemblies 120 move relative to the frame 140 and the processing path 104 when moved between the operating position 134 and the loading position 136, as indicated in FIGS. 2-5.

Figure 6:
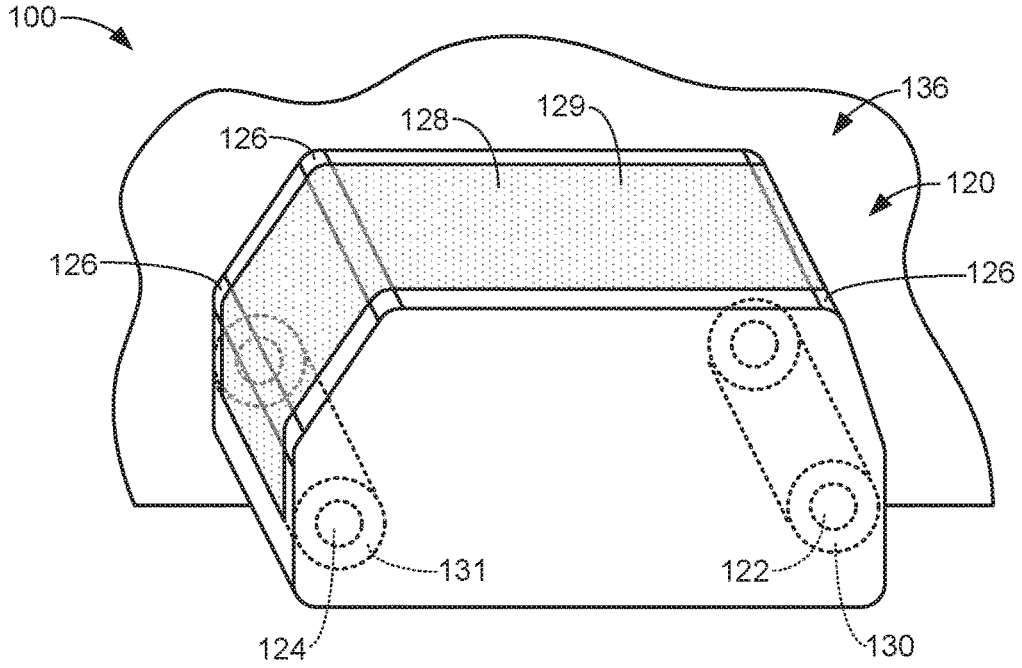
FIG. 6 is a simplified isometric view of a portion of a credential production device including a processing assembly in a loading position, in accordance with embodiments of the invention.

In some embodiments, the cantilevered loading position 136 of each transfer assembly 120 allows for substantially unencumbered loading and unloading of the ribbon 129 in the assembly 120. In some embodiments, the supply spool support 122, the take-up spool support 124, the ribbon supports 126, and the ribbon path 128 are accessible for loading or unloading the ribbon 129 when the transfer assembly 120 is in the loading position 136, as generally shown in FIG. 6, which is a simplified isometric view of a portion of the device 100 including a processing assembly 120 in a loading position 136, in accordance with embodiments of the invention. Only portions of exemplary ribbon supports 126 are shown in FIG. 6 in order to simplify the drawing.

In some embodiments, the ribbon 129 is installed in the processing assembly by first securing the supply spool 130 or the take-up spool 131 to the corresponding support 122 or 124. The ribbon 129 is then laid over the ribbon supports 126, and the non-secured spool 130 or 131 is then installed on the corresponding support 122 or 124 to complete the loading of the ribbon 129. In some embodiments, it is not necessary to feed the ribbon 129 through an opening when the processing assembly 120 is in the loading position 136. That is, a user is able to wrap the ribbon 129 around the corresponding ribbon supports 126 in one motion without having to feed the ribbon 129 through an opening due to the exposure of the ribbon path 128 while the assembly 120 is in the cantilevered loading position 136. The processing assembly 120 can then be moved back to the operating position 134 using the assembly guide 132 to allow a credential production process to be performed using the ribbon 129.

In some embodiments, the processing assembly 120A is in the form of a transfer assembly and the ribbon 129A is in the form of a transfer ribbon. In some embodiments, the transfer assembly 120A is configured to perform a transfer operation using the ribbon 129A, during which a section of overlaminate material is transferred from the transfer ribbon 129A to a surface 150 of a substrate 110, when the transfer assembly 120A is in the operating position 134A. In some embodiments, the transfer assembly 120A includes a transfer roller 152, which heats and presses the section of overlaminate material against the surface 150 during a transfer operation while the substrate 110 is fed along the processing path 104, as illustrated in phantom lines in FIG. 1. In some embodiments, the device 100 includes a pair of ribbon supports 126A located on opposing sides of the transfer roller 152 that support the transfer ribbon 129A for engagement with the transfer roller 152 when the transfer assembly 120A is in the operating position 134A, as shown in FIG. 1.

Figure 7:
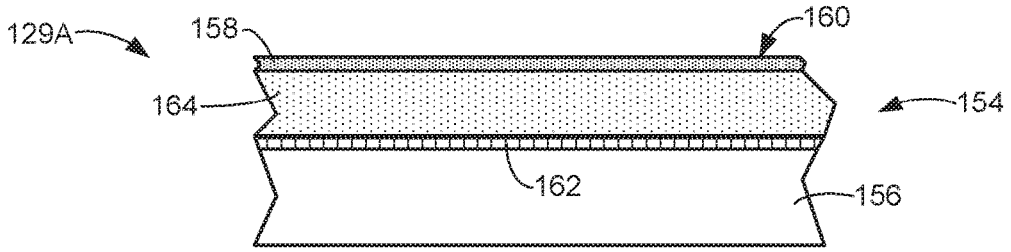
FIG. 7 is a simplified cross-sectional view of a transfer ribbon that includes a transfer layer in accordance with exemplary embodiments of the invention.

In some embodiments, the section of overlaminate material is in the form of a transfer layer or an overlaminate patch. FIG. 7 is a simplified cross-sectional view of a transfer ribbon 129A that includes a transfer layer 154, in accordance with exemplary embodiments of the invention. In some embodiments, the transfer layer 154 is attached to a backing or carrier layer 156. In some embodiments, the transfer layer 154 is in the form of a fracturable laminate or thin film laminate. In some embodiments, the transfer layer 154 includes a thermal adhesive 158, which is activated during a transfer lamination process using the transfer roller 152 to bond a section of the transfer layer 154 to the surface 150 of the substrate 110. In some embodiments, the transfer layer 154 includes an image receptive surface 160 on the thermal adhesive 158 that is configured to receive a printed image, as discussed below. The transfer ribbon 129A may also include a release layer 162 between the transfer layer 154 and the carrier layer 156 that assists in releasing the transfer layer 154 from the carrier layer 156 during a transfer lamination process.

In some embodiments, the transfer layer 154 includes a protective layer 164 located between the adhesive layer 158 and the carrier layer 156. Alternatively, the protective layer 164 may be combined with the adhesive layer 158. The protective layer 164 operates to provide protection to the surface 150 of the substrate 110 to which the transfer layer 154 is laminated. The protective layer 164 may also protect an image printed on the image receptive surface 160 when the transfer layer 154 is laminated to a surface 150 of a substrate 110. Other conventional materials or layers may also be included in the transfer ribbon 129A and the transfer layer 154.

Figure 8:
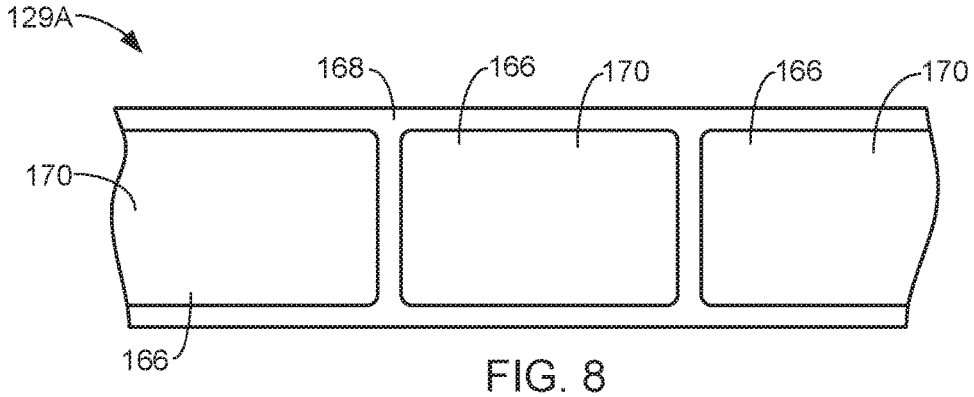
FIG. 8 is a simplified top view of a portion of a transfer ribbon that includes a plurality of overlaminate patches, in accordance with embodiments of the invention.

As mentioned above, the transfer ribbon 129A may also comprise an overlaminate material in the form of an overlaminate patch, which can be transferred to the surface 150 of a substrate 110 during a transfer lamination operation using the transfer assembly 120A. FIG. 8 is a simplified top view of a portion of a transfer ribbon 129A that includes a plurality of overlaminate patches 166. The overlaminate patches 166 are attached to a backing or carrier layer 168, and an exposed surface 170 of the overlaminate patches 166 includes a layer of thermal adhesive that is bonded to the surface 150 of the substrate 110 during a transfer lamination operation using the transfer roller 152, to transfer an individual overlaminate patch 166 from the carrier layer 168 to the surface 150. Each overlaminate patch 166 is formed of a polyester film or other suitable material that provides protection to the surface 150 of the substrate 110. The surface 170 may also include an image receptive material for receiving a printed image, as discussed below.

In some embodiments, the transfer assembly 120A includes a transfer roller lift mechanism 172 that is configured to move the transfer roller 152 relative to the processing path 104 between a retracted position (solid lines) and a laminating position (phantom lines), as indicated by arrow 174 in FIG. 1. The transfer roller lift mechanism 172 generally moves the transfer roller 152 to the retracted position during periods in which the transfer assembly 120A is not performing a transfer lamination operation, such as when the transfer assembly 120A is in the loading position 136A. During a lamination operation, the transfer roller lift mechanism 172 moves the transfer roller 152 to the laminating position, in which the transfer roller 152 presses the transfer ribbon 129A against the surface 150 of the substrate 110, which is supported by a platen roller 176 in the processing path 104. The heat and pressure generated by the transfer roller 152 during the transfer lamination operation bonds the section of overlaminate material (transfer layer 154 or overlaminate patch 166) to the surface 150 of the substrate 110, as the substrate 110 is fed along the processing path 104 using the transport mechanism 106. The carrier layer 156 is then peeled from the section of overlaminate material that has bonded to the surface 150 of the substrate 110, and wound onto the take-up spool 131A. As a result, the substrate 110 includes the overlaminate material bonded to the surface 150 following processing by the transfer assembly 120A.

As discussed below, this transfer operation may occur after an image is printed to an image receptive surface of the overlaminate material, such as to the surface 160 (FIG. 7) of the transfer layer 154, or the surface 170 of the overlaminate patch 166 (FIG. 8). The imaged surface of the transferred overlaminate material faces the surface 150 of the substrate. Thus, the transfer layer 164 or overlaminate patch 166 provides protection to the surface 150 of the substrate 110 and the image from environmental conditions and abrasion.

In some embodiments, the transfer assembly 120A includes one or more motors 178, as shown in FIG. 1. In some embodiments, the transfer assembly 120A includes a motor 178A that is configured to drive rotation of the transfer roller 152 about an axis 180 that is generally parallel to the surface 150 of the substrate 110 and perpendicular to the feed direction 111.

In some embodiments, the transfer assembly 120A includes a transfer roller lift motor 178B that is configured to move the transfer roller 152 and its axis of rotation 180 relative to the processing path 104, as indicated by arrow 174.

In some embodiments, the transfer assembly 120A includes one or more feed rollers 182, which are configured to drive the feeding of the transfer ribbon 129A along the ribbon path 128A. In some embodiments, the transfer assembly 120A includes a feed motor 178C that is configured to drive rotation of each feed roller 182.

In some embodiments, the transfer assembly 120A includes a platen roller 184 and a motor 178D that is configured to drive rotation of the platen roller 184.

In some embodiments, the transfer assembly 120A includes a supply spool motor 178E that is configured to control the feeding of the transfer ribbon 129A along the ribbon path 128A, and the winding and unwinding of the transfer ribbon 129A on the supply spool 130A. In some embodiments, the transfer assembly 120A includes a take-up spool motor 178F that is configured to drive rotation of the take-up spool support 124A, to control the feeding of the transfer ribbon 129A along the ribbon path 128A and the winding and unwinding of the transfer ribbon 129A on the take-up spool 131A.

In some embodiments, the transfer assembly 120A includes gears or other mechanisms that are disengaged from corresponding motorized gears or mechanisms supported by the frame 140 when the transfer assembly 120A is in the loading position 136A, and engage the corresponding motorized gears or mechanisms supported by the frame 140 when the transfer assembly 120A is in the operating position. In some embodiments, the gears of the transfer assembly 120A allow motors that are not supported by the transfer assembly 120A to drive one or more components of the transfer assembly 120A described above, such as the transfer roller 152, the feed rollers 182, the supply spool 130A or the supply spool support 122A, the take-up spool 131A or the take-up spool support 124A, the lift mechanism 172, and/or the platen roller 184, for example.

As mentioned above, in some embodiments, the credential production device 100 is configured to print an image to the overlaminate material before the overlaminate material is bonded to the surface 150 of the substrate 110 during a transfer lamination operation. In some embodiments, the processing assembly 120B is in the form of a print assembly, and the ribbon 129B is in the form of a print ribbon. In some embodiments, the print assembly 120B includes a print head 190 that is configured to print an image to the overlaminate material of the transfer ribbon 129A using the print ribbon 129B, as indicated in phantom lines in FIG. 1, when the transfer assembly 120A and the print assembly 120B are in their operating positions 134.

In some embodiments, the print ribbon 129B is in the form of a thermal print ribbon, and the print head 190 is a conventional thermal print head that includes a plurality of heating elements. In some embodiments, the print assembly 120B includes at least a pair of ribbon supports 126B that are configured to support the print ribbon 129B for engagement with the print head 190 when the print assembly 120B is in the operating position 134B, as shown in FIG. 1. The heating elements of the print head 190 heat the print ribbon 129A and cause dye, resin, and/or other print materials to transfer to the transfer ribbon 129A and form the desired image on the overlaminate material, in accordance with conventional techniques.

In some embodiments, the print assembly 120B utilizes an ink jet print head 190, which applies ink to the transfer ribbon 129A to produce a desired image on the overlaminate material. In this case, the print ribbon 129B, the supply spool 130B, the take-up spool 131B, and other ribbon supporting components of the print assembly 120B can be eliminated from the print assembly 120B shown in FIG. 1. In some embodiments, the main frame 140 of the device 100 supports an ink jet print head for printing to the transfer ribbon 129A, thus eliminating the need for the print assembly 120B. One example of a device that utilizes an ink jet print head to print images to a transfer ribbon is described in PCT Application No. PCT/IB2015/050150, which is incorporated herein by reference in its entirety.

In some embodiments, the print assembly 120B includes a print head lift mechanism 192 that is configured to move the print head 190 between a retracted position, in which the print head 190 does not press the print ribbon 129B against the transfer ribbon 129A supported by the platen roller 184, and a print position, in which the print head 190 presses the print ribbon 129B against the transfer ribbon 129A under the support of the platen roller 184, as indicated in phantom lines in FIG. 1.

In some embodiments, the print assembly 120B includes one or more motors 194. In some embodiments, the print assembly 120B includes a motor 194A that is configured to drive the print head lift mechanism 192 to move the print head 190 between the retracted and print positions. In some embodiments, the print assembly 120B includes a supply spool motor 194B that is configured to drive rotation of the supply spool support 122B, and control the feeding of the print ribbon 129B along the ribbon path 128B, the winding of the print ribbon 129B on the supply spool 130B, and/or the unwinding of the print ribbon 129B from the supply spool 130B. In some embodiments, the print assembly 120B includes a take-up spool motor 194C that is configured to drive rotation of the take-up spool support 124B to control the feeding of the print ribbon 129B along the ribbon path 128B, the winding of the print ribbon 129B on the take-up spool 131B, and/or the unwinding of the print ribbon 129B from the take-up spool 131B.

In some embodiments, the print assembly 120B includes gears or other mechanisms that are disengaged from corresponding motorized gears or mechanisms supported by the frame 140 when the print assembly 120B is in the loading position 136B, and engage the corresponding motorized gears or mechanisms supported by the frame 140 when the print assembly 120B is in the operating position. In some embodiments, the gears of the print assembly 120B allow motors that are not supported by the print assembly 120B to drive one or more components of the print assembly 120B described above, such as the supply spool 130B or the supply spool support 122B, the take-up spool 131B or the take-up spool support 124B, and/or the print head lift mechanism 192, for example.

During a print operation, the print assembly 120B is moved to the operating position 134B using the assembly guide 132B. In some embodiments, the transfer assembly 120A is also moved to the operating position 134A using the assembly guide 132A. In some embodiments, the transfer ribbon 129A is fed along the transfer ribbon path 128A to align a desired section of the overlaminate material (transfer layer 154 or overlaminate patch 166) in position relative to the print platen 184 and the print head 190 using conventional techniques. In some embodiments, the print head 190 is moved from the retracted position to the print position using the print head lift mechanism 192, such that the print head 190 presses the print ribbon 129B against the transfer ribbon 129A, which is supported by the print platen 184. The print head selectively transfers print material from the print ribbon 129B to the overlaminate material of the transfer ribbon 129A using conventional techniques to form an image on the overlaminate material. In some embodiments, following the print operation, the print head 190 is moved to the retracted position using the print head lift mechanism 192.

The imaged overlaminate material or section of the transfer ribbon 129A is then fed to the transfer roller 152 by driving rotation of one or more feed rollers 182, the supply spool 130A, and/or the take-up spool 131A using the corresponding motors 178. In some embodiments, the transfer roller 152 is moved from the retracted position to the laminating position using the transfer roller lift mechanism 172. With the imaged overlaminate material of the transfer ribbon 129A aligned with the surface 150 of the substrate 110, the transfer roller 152 commences a transfer lamination operation, in which the transfer roller heats and presses the imaged overlaminate material against the surface 150 as the substrate 110 is fed along the processing path 104 using the transport mechanism 106. This bonds the imaged overlaminate material to the surface 150. The backing or carrier layer 156 is then removed from the transferred imaged overlaminate material to complete the transfer lamination operation. Following the transfer operation, the surface 150 includes the image, which is protected by the overlaminate material.

In some embodiments, the device 100 includes an accumulator 196. The accumulator 196 is configured to take up slack in the ribbon 129A during transfer and/or print operations, as indicated in phantom lines.

The credential production device 100 may include additional substrate processing devices, such as card rotators, a magnetic stripe reader/writer, a data encoder, or other substrate processing device, which can perform additional processes on the substrate 110. Such processing devices may be included in the at least one processing assembly 120. Once the processing of the substrate 110 is completed, the processed substrate 110 may be discharged from the device 100 into an appropriate bin, for example.

Figure 9:
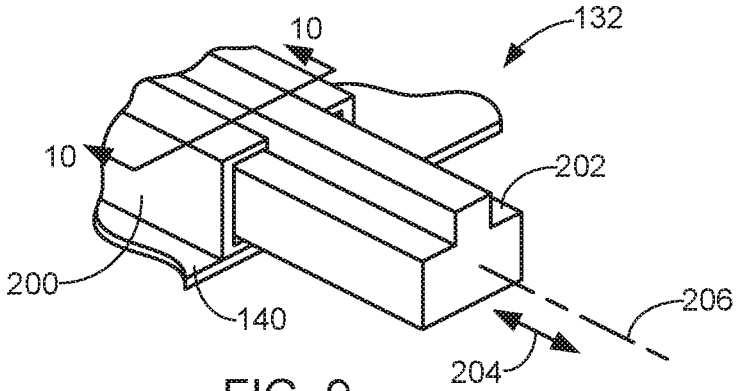
FIG. 9 is a simplified isometric view of a portion of an assembly guide, in accordance with exemplary embodiments of the invention.
Figure 10:
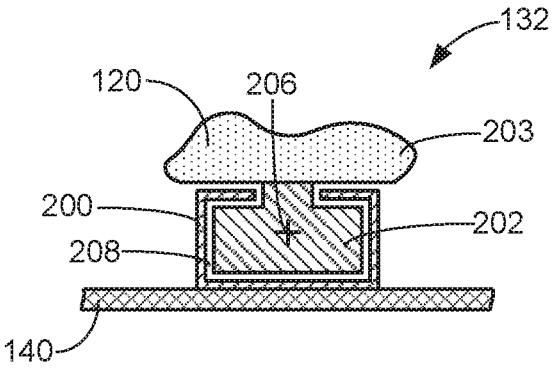
FIG. 10 is a simplified cross-sectional view of the assembly guide of FIG. 9 and a portion of a processing assembly taken generally along line 10-10 of FIG. 9.
Figure 11:
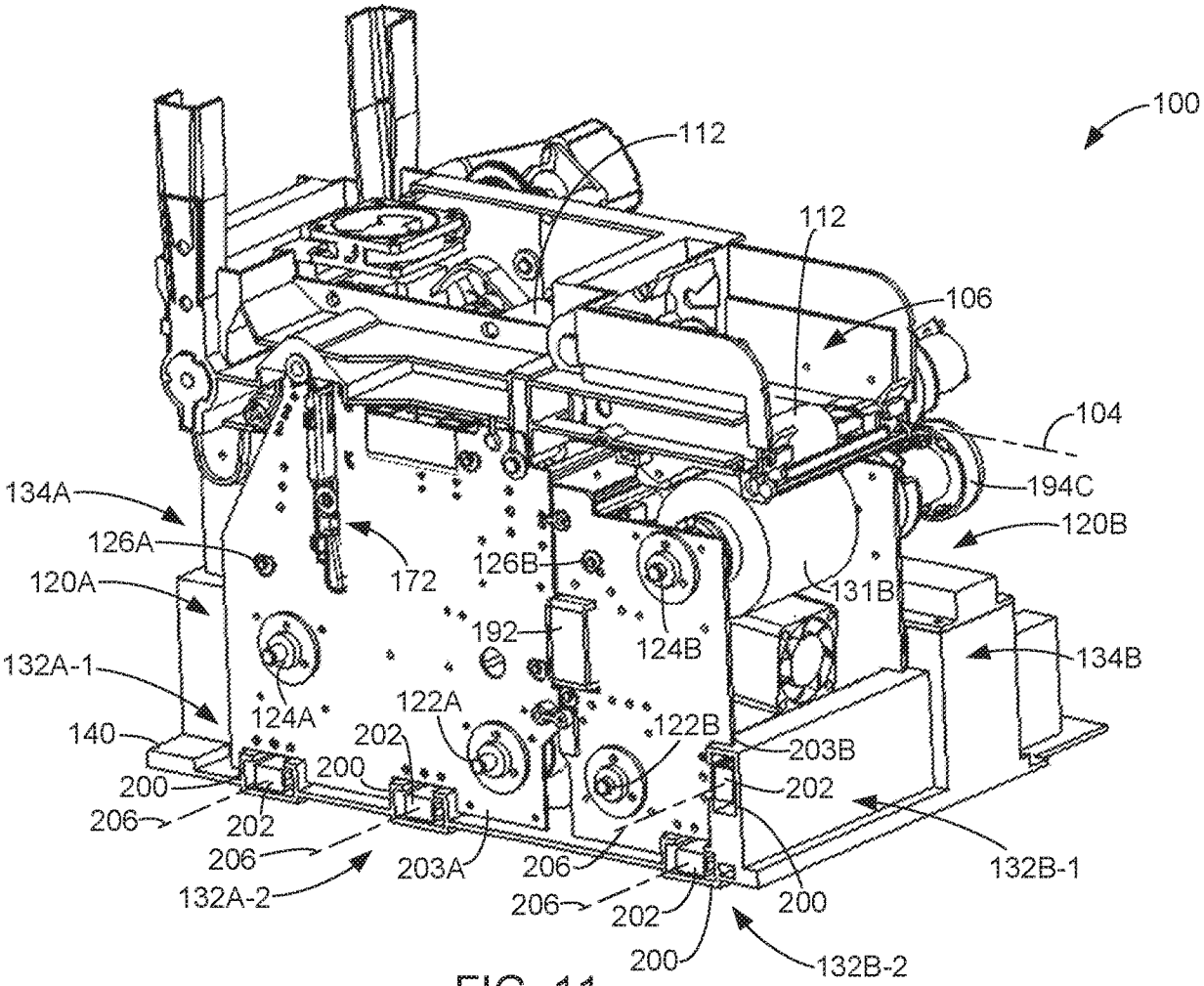
FIG. 11 is an isometric view of an exemplary credential production device illustrating operating positions of a transfer assembly and a print assembly, in accordance with exemplary embodiments of the invention.
Figure 12:
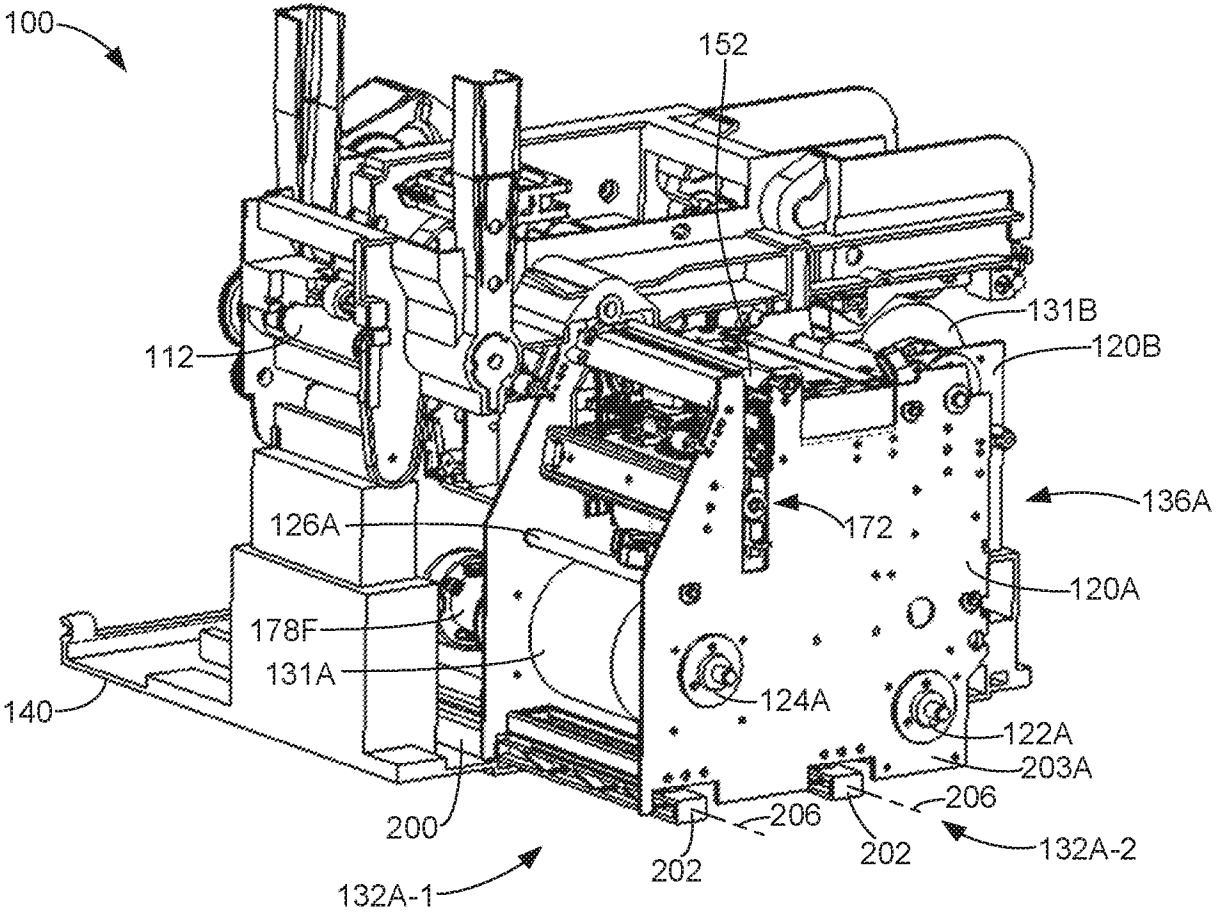
FIG. 12 is an isometric view of the device of FIG. 11 illustrating the transfer assembly in a loading position, and the print assembly in the operating position, in accordance with exemplary embodiments of the invention.
Figure 13:
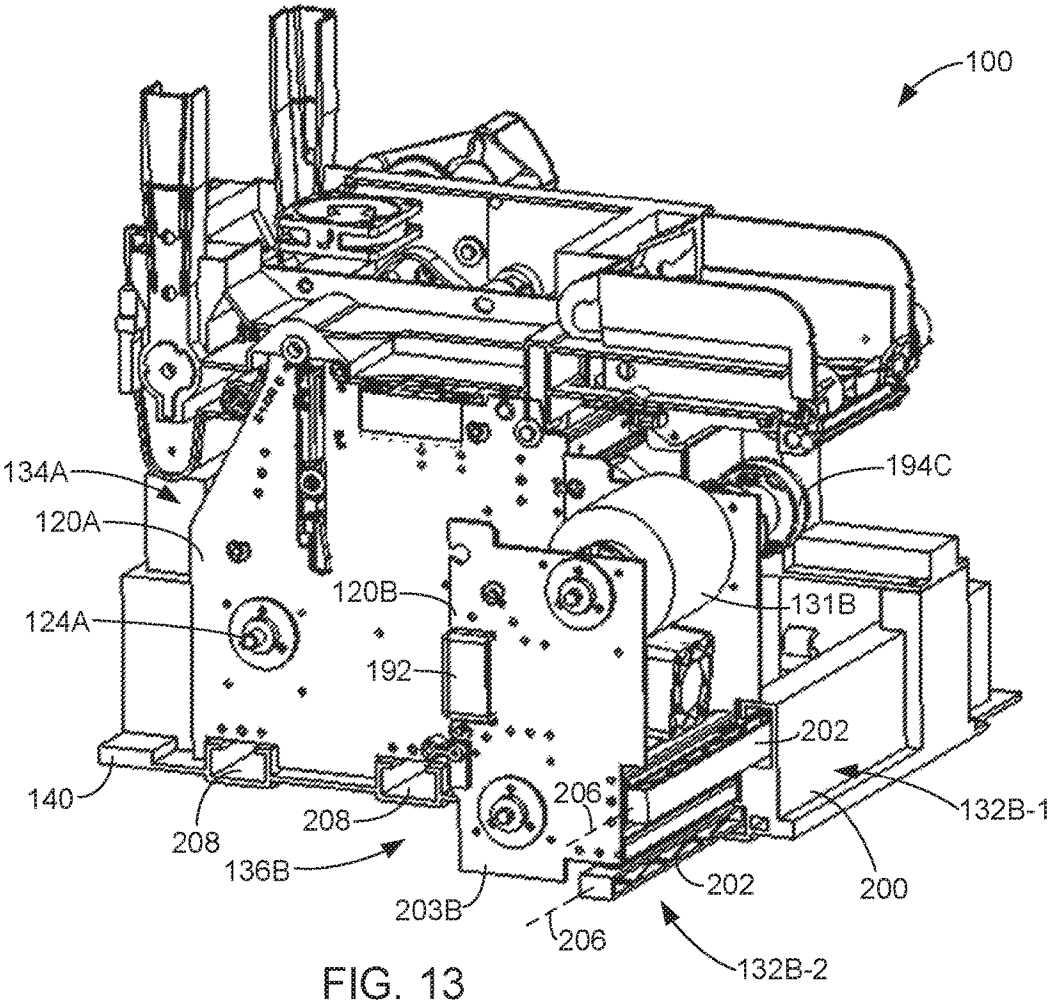
FIG. 13 is an isometric view of the device of FIG. 11 with the transfer assembly in the operating position, and the print assembly in a loading position, in accordance with exemplary embodiments of the invention.
Figure 14:
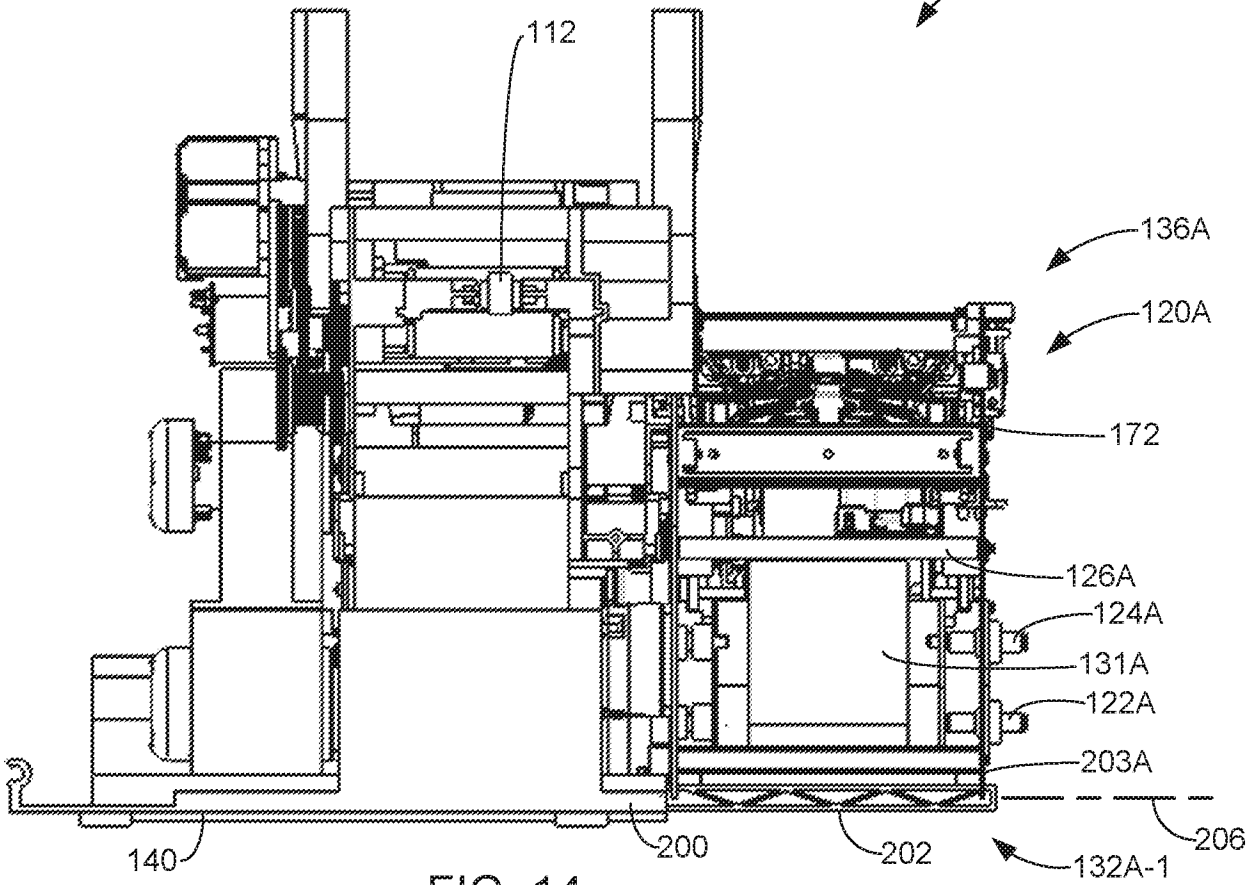
FIG. 14 is a side view of the device of FIG. 11 with the transfer assembly in the loading position, in accordance with exemplary embodiments of the invention.

FIG. 9 is an isometric view of a portion of an assembly guide 132 in accordance with exemplary embodiments of the invention. FIG. 10 is a cross-sectional view of the assembly guide of FIG. 9 and a portion of a processing assembly 120 taken generally along line 10-10 of FIG. 9. FIGS. 11-14 provide various views of an exemplary credential production device 100 with its external housing removed. FIG. 11 is an isometric view of the device 100 with the transfer assembly 120A and the print assembly 120B in their operating positions 134A and 134B. FIG. 12 is an isometric view of the device 100 with the transfer assembly 120A in its loading position 136A, and the print assembly 120B in the operating position 134B. FIG. 13 is an isometric view of the device 100 with the transfer assembly 120A in the operating position 134A, and the print assembly 120B in the loading position 136B. FIG. 14 is a side view of the device 100 with the transfer assembly 120A in the loading position 136A.

In some embodiments, each processing assembly includes at least one assembly guide 132. For example, in some embodiments, the transfer assembly 120A includes assembly guides 132A-1 and 132A-2, as shown in FIGS. 11 and 12, and the print assembly 120B includes assembly guides 132B-1 and 132B-2, as shown in FIGS. 11 and 13. In some embodiments, each assembly guide 132 of the device 100 supports the corresponding processing assembly 120 such that it slides linearly between the loading and operating positions similar to a drawer. As discussed above, in some embodiments, the assembly guides 132 cantilever the corresponding processing assembly 120 when the processing assembly 120 is in the loading position 136. The assembly guides 132 may take on various forms while providing these functions.

In some embodiments, each assembly guide 132 includes a guide member 200, which is attached to the frame 140 of the device 100, as shown in FIGS. 9, 10 and 12-14. The guide members 200 may be welded to the frame 140, screwed to the frame 140, formed integral to the frame 140, or attached to the frame 140 using another suitable technique. Due to this attachment to the frame 140 of the device 100, the guide members 200 have a fixed position relative to the frame 140.

In some embodiments, the assembly guide 132 includes a member 202, which is attached to the processing assembly 120, such as a frame 203 (e.g., sidewalls) of the processing assembly 120, as shown in FIG. 10. For example, in some embodiments, each guide member 132A includes a member 202 that is attached to a frame 203A of the processing assembly 120A, and each guide member 132B is attached to a frame 203B of the processing assembly 120B, as shown in FIGS. 11-14. The guide member 202 may be welded to the processing assembly 120 (i.e., frame 203), screwed to the processing assembly 120, formed integral to the processing assembly 120, or attached to the processing assembly 120 using another suitable fastening technique. In some embodiments, the member 202 has a fixed position relative to at least a portion of the processing assembly 120 (e.g., frame, side wall, etc.) due to this attachment to the processing assembly 120.

In some embodiments, the guide member 202 is configured to move relative to the guide member 200 as indicated by arrow 204 in FIG. 9. In some embodiments, this movement of the guide member 202 is along an axis 206 of a channel 208 formed by the guide member 200, which are shown in FIG. 10. In some embodiments, the axes 206 of the guide members 200 corresponding to each of the processing assemblies 120 are parallel to each other to facilitate the drawer-like movement of the processing assembly 120 along the axes 206. In some embodiments, rotation of the guide member 202 is restricted about the axis 206 by an interior wall of the channel 208 of the guide member 200, or using another suitable technique.

In operation, a user can transition a processing assembly 120 from the operating position 134 to the loading position 136 by pulling the processing assembly 120 along the axes 206 of the guide members 200. Thus, the transfer assembly 120A can be transitioned from the operating position 134A (FIG. 11) to the loading position 136A (FIGS. 12 and 14) by pulling the transfer assembly 120A away from the frame 140 or the processing path 104 and along the axes 206 of the guide members 200. The transfer assembly 120A can be returned to the operating position 134 (FIG. 11) by pushing the transfer assembly 120A toward the frame 140 or the processing path 104 and along the axes 206 of the guide members 200. Similarly, the print assembly 120B may be transitioned from the operating position 134B (FIG. 11) to the loading position 136B (FIG. 13) by pulling the print assembly 120B away from the frame 140 or the processing path 104 and along the axes 206 of the guide members 200. The print assembly 120B may be returned to the operating position 134B (FIG. 11) by pushing the print assembly 120B toward the frame 140 or the processing path and along the axes 206 of the guide members 200.

Embodiments of the device 100 provide advantages over conventional credential production devices. For instance, the inclusion of motors (e.g., 178 and 194), processing devices (e.g., transfer roller 152, print head 190), ribbon supports 126, supply spool supports (122), and/or take-up spool supports (124) in the movable processing assembly 120 allows the relative positions of the components to be accurately maintained over numerous ribbon loading and unloading cycles. As a result, accurate alignment between the components can be maintained while facilitating simplified loading of a ribbon 129 (transfer ribbon 129A or print ribbon 129B) in the device 100. On a design point of view, in some embodiments of the device 100, each processing assembly will look like a modular drawer which can be pulled in and out of the main production device frame, to be loaded with ribbons, repaired, replaced, upgraded, etc. Embodiments of the credential production device 100 described herein also provide other advantages and benefits over conventional credential production devices.

Although the present invention has been described with reference to preferred embodiments, workers skilled in the art will recognize that changes may be made in form and detail without departing from the spirit and scope of the invention.

COPYRIGHT AND LEGAL NOTICES

A portion of the disclosure of this patent document contains material which is subject to copyright protection in the United States. The copyright owner has no objection to the facsimile reproduction by anyone of the patent document or the patent disclosure, as it appears in the Patent and Trademark Office patent files or records, but otherwise reserves all copyrights whatsoever.

What is claimed is:

1. A credential production device comprising:
processing path;
a transport mechanism configured to feed individual substrates along the processing path;
a processing assembly comprising:
a supply spool support;
a take-up spool support;
a plurality of ribbon supports that define a ribbon path; and
one of a print head and a transfer roller; and
at least one assembly guide configured to guide linear movement of the processing assembly substantially perpendicularly to the processing path between an operating position and a loading position relative to the processing path.

2. The credential production device according to claim 1, wherein the processing assembly is cantilevered by the at least one assembly guide when the processing assembly is in the loading position.

3. The credential production device according to claim 1, wherein:
the credential production device includes a main frame having a fixed position relative to the processing path; and
each assembly guide includes:
a first guide member attached to the main frame; and
a second guide member attached to the processing assembly and engaging the first guide member;
the second guide member and the processing assembly move between the loading and operating positions relative to the main frame and the first guide member.

4. The credential production device according to claim 3, wherein the first guide member includes a channel that receives an end of the second guide member, and the second guide member slides within the channel of the first guide member as the processing assembly moves between the loading and operating positions.

5. The credential production device according to claim 1, wherein the processing assembly includes at least one motor selected from the group consisting of:
a supply spool motor configured to rotate the supply spool support;
a take-up spool motor configured to rotate the take-up spool support;
a feed motor configured to drive rotation of a feed roller;
a transfer roller motor configured to drive rotation of the transfer roller;
a transfer roller lift motor configured to move an axis of rotation of the transfer roller relative to a frame of the processing assembly; and
a print head lift motor configured to move the print head relative to the frame of the processing assembly.

6. The credential production device according to claim 1, wherein:
the processing assembly includes a transfer assembly comprising the transfer roller, which is configured to transfer a section of overlaminate material from a transfer ribbon extending between a supply spool supported by the supply spool support and a take-up spool supported by the take-up spool support to a substrate in the processing path when the transfer assembly is in the operating position; and
the overlaminate material comprises a transfer layer or an overlaminate patch.

7. The credential production device according to claim 6, wherein the ribbon supports include a pair of ribbon supports configured to support the transfer ribbon for engagement with the transfer roller when the transfer assembly is in the operating position.

8. The credential production device according to claim 6, wherein:
the credential production device further comprises a print assembly comprising:
a supply spool support;
a take-up spool support;
a plurality of ribbon supports that define a ribbon path;
a print head; and
at least one print assembly guide, each configured to guide movement of the print assembly substantially perpendicularly to the processing path between an operating position and a loading position relative to the processing path.

9. The credential production device according to claim 8, wherein the print assembly is cantilevered by the at least one print assembly guide when the print assembly is in the loading position.

10. The credential production device according to claim 8, wherein:

the credential production device includes a main frame having a fixed position relative to the processing path; and each print assembly guide includes:

a third guide member attached to the main frame; and a fourth guide member attached to the print assembly and engaging the third guide member;

wherein the fourth guide member and the print assembly move between the loading and operating positions relative to the main frame and the third guide member.

11. The credential production device according to claim 10, wherein the third guide member includes a channel that receives an end of the fourth guide member, and the fourth guide member slides within the channel of the third guide member as the print assembly moves between the loading and operating positions.

12. The credential production device according to claim 8, wherein:

the transfer assembly includes a platen roller;

the print assembly includes a print ribbon extending between supply and take-up spools that are respectively supported on the supply and take-up spool supports of the print assembly; and the print head is configured to print an image to the transfer ribbon using the print ribbon and the platen roller when the print assembly and the transfer assembly are each in their operating position.

13. The credential production device according to claim 1, wherein the processing assembly includes a print assembly comprising the print head, which is configured to print an image using a print ribbon extending between a supply spool supported by the supply spool support and a take-up spool supported by the take-up spool support when the print assembly is in the operating position.

14. The credential production device according to claim 13, wherein the ribbon supports include a pair of ribbon supports configured to support the print ribbon for engagement with the print head when the print assembly is in the operating position.

15. The credential production device according to claim 1, wherein:

the processing path is substantially flat;

the credential production device further comprises a supply of card substrates; and the transport mechanism is configured to feed individual card substrates from the supply along the processing path in a feed direction that is parallel to the processing path.

16. A credential production device comprising:

a processing path;

a transport mechanism configured to feed individual substrates along the processing path;

a processing assembly comprising:

a supply spool support;

a take-up spool support;

a plurality of ribbon supports that define a ribbon path;

one of a print head and a transfer roller; and at least one motor selected from the group consisting of:

a supply spool motor configured to rotate the supply spool support;

a take-up spool motor configured to rotate the take-up spool support;

a feed motor configured to drive rotation of a feed roller;

a transfer roller motor configured to drive rotation of the transfer roller;

a transfer roller lift motor configured to move an axis of rotation of the transfer roller relative to a frame of the processing assembly; and a print head lift motor configured to move the print head relative to the frame of the processing assembly, and at least one assembly guide configured to guide movement of the processing assembly substantially perpendicularly to the processing path between an operating position and a loading position relative to the processing path.

17. The credential production device according to claim 16, wherein:

the credential production device includes a main frame having a fixed position relative to the processing path; and each assembly guide includes:

a first guide member attached to the main frame; and a second guide member attached to the processing assembly and engaging the first guide member;

the second guide member and the processing assembly move between the loading and operating positions relative to the main frame and the first guide member.

18. The credential production device according to claim 16, wherein:

the processing assembly includes a transfer assembly comprising the transfer roller, which is configured to transfer a section of overlaminate material from a transfer ribbon extending between a supply spool supported by the supply spool support and a take-up spool supported by the take-up spool support to a substrate in the processing path when the transfer assembly is in the operating position; and the overlaminate material comprises a transfer layer or an overlaminate patch.

19. The credential production device according to claim 16, wherein the processing assembly includes a print assembly comprising the print head, which is configured to print an image using a print ribbon extending between a supply spool supported by the supply spool support and a take-up spool supported by the take-up spool support when the print assembly is in the operating position.

20. The credential production device according to claim 16, wherein:

the processing path is substantially flat;

the credential production device further comprises a supply of card substrates; and the transport mechanism is configured to feed individual card substrates from the supply along the processing path in a feed direction that is parallel to the processing path.

* * * * *